US005673643A

United States Patent [19]

Poppa

[11] Patent Number: 5,673,643

[45] Date of Patent: Oct. 7, 1997

[54] HYDROFOIL ACCESSORY FOR MARINE PROPULSION DEVICE

[76] Inventor: Michael J. Poppa, 7106 Torresdale Ave., 2nd Floor, Philadelphia, Pa. 19135

[21] Appl. No.: 723,010

[22] Filed: Sep. 30, 1996

[51] Int. Cl.[6] ..... B63H 25/06

[52] U.S. Cl. ..... 114/162; 114/274; 440/66; 440/71

[58] Field of Search ..... 440/40, 52, 66, 440/67, 68, 69, 71; 114/162, 271, 274, 281

[56] References Cited

U.S. PATENT DOCUMENTS

| | | | |
|---|---|---|---|
| 4,738,644 | 4/1988 | Happel | 440/66 |
| 4,861,292 | 8/1989 | Griffiths | 440/53 |
| 4,944,702 | 7/1990 | Cain | 440/51 |
| 4,955,963 | 9/1990 | Snyder | 440/53 |
| 4,977,847 | 12/1990 | Bartlett | 114/274 |
| 5,005,507 | 4/1991 | Dyer | 440/51 |
| 5,016,553 | 5/1991 | Spencer | 440/51 |
| 5,066,255 | 11/1991 | Sand | 440/66 |
| 5,194,025 | 3/1993 | Blanchard | 440/52 |
| 5,207,605 | 5/1993 | Kroeber | 440/71 |
| 5,231,950 | 8/1993 | Poulos | 440/51 |

*Primary Examiner*—Stephen Avila
*Attorney, Agent, or Firm*—Jeffrey T. Spangler

[57] ABSTRACT

A hydrofoil wing structure is disclosed to be employed as an accessory for a marine propulsion device, to be disposed above and mostly aft of the propelling means of such a device, to contour and concentrate the kinetic energy in the hydrodynamic vortex created by the propelling means; to reduce turbulence, vibration and noise by reflecting acoustic energy downwardly from the surface of the water; to increase the efficiency of such a device powered by an electric battery; to improve the steering and maneuverability of the vessel by providing a rudder for the device; and to serve as a guard preventing the propelling means from entanglement in vegetation or its damage from submerged objects, and to similarly shield a sonar transducer or other instrument used in conjunction with the device for finding fish or gauging the depth of the water.

5 Claims, 3 Drawing Sheets

HYDROFOIL ACCESSORY FOR MARINE PROPULSION DEVICE

BACKGROUND OF THE INVENTION

1. Technical Field

This invention is an accessory for a marine propulsion device which functions as a hydrofoil wing to contour and concentrate the kinetic energy in the hydrodynamic vortex created by the propeller, thereby reducing turbulence, vibration and noise, increasing the efficiency of such a device powered by an electric battery, improving the steering and maneuverability of the vessel, serving as a propeller guard to prevent its entanglement in vegetation or its damage from submerged objects, and similarly shielding a sonar transducer or other instrument used for finding fish or gauging the depth of the water.

2. Background Information

Freshwater sport fishing, especially the technique of trolling, requires a marine propulsion device which is powerful enough to drive a small vessel slowly through the water for several hours, yet quiet enough not to distract or alert the fish, and resistant to entanglement in or damage from submerged vegetation or objects. Typically, such a trolling motor is mounted on the transom at the stern, or less frequently on the bow, and it is powered by a direct current marine storage battery.

Such trolling motors typically consist of a control panel and steering arm mounted on the top of a shaft, with the shaft mounted on the transom or the bow of the vessel, and the shaft extending downwardly to an electric motor and propeller, which are submerged. Some known disadvantages of commonly used trolling motors include their noise, vibration and turbulence; the tendency of their typically unshielded propellers to become entangled in or damaged by vegetation or other submerged objects; inefficiency in the use of electric power, limiting the time a motor can be used on a fully charged battery; and poor steering and maneuverability in the absence of any functional rudder component on known varieties of trolling motors.

Propeller guards are available for gasoline-powered motors, of the sort disclosed in U.S. Pat. No. 5,207,605 which are disposed underneath and forward of the propeller, to deflect submerged vegetation and objects, but these devices have no utility other than as barriers to submerged vegetation or objects. No accessory or motor, either gasoline or electric, having the multiple functions of the invention claimed in this application is disclosed, taught or suggested by the prior art.

While traditional hydrofoils are employed upon the hull or marine propulsion device to affect the trim of a vessel and forces acting upon its hull during propulsion at relatively high speeds, this invention has little effect upon these forces at the low speeds achieved with an electric trolling motor. The present hydrofoil is directed principally toward reducing the negative effects of low-speed electric trolling motors which are disadvantages for the sport fisher, such as noise, vibration, turbulence, entanglement in vegetation or damage by submerged objects, poor steering and maneuverability, and inefficient use of electric storage batteries.

SUMMARY OF THE INVENTION

Broadly, this invention comprises an integral wing structure which is adjustably and fixedly attached to the shaft [9] of a trolling motor [9] so the wing is disposed above and mostly aft of the motor [9] and propeller [10], and in hydrodynamic contact with the approximately conical vortex of kinetic energy created by the propeller [10]. The center surface [1] of the wing remains parallel to the surface of the water when in use, and is flanked on both sides by side surfaces [2], which are contoured downwardly from the center surface [1], with the side surfaces [2] in turn flanked by rudder surfaces [3], each of which is perpendicular to the surface of the water.

Topologically, the integral wing surfaces are constructed to approximate the portion of a cone which has been divided by a plane approximately parallel to its axis, and this conic section is fixedly disposed on the motor shaft so that it is in contact with and contours the conical vortex of kinetic energy created by the propeller, and to reflect acoustic energy from the motor and propeller downwardly from the surface of the water.

Depending on how closely the wing is placed to the propeller [10], the vortex will be deflected more or less downwardly from the surface of the water by the center surface [1] when the wing is in use, and the vortex will be further contoured by the side surfaces [2] to concentrate its motive force into a smaller cross-sectional area, thus increasing the efficient use of stored electrical power. The rudder surfaces [3] also contribute to this contouring, and further act as rudders to increase the maneuverability of the vessel when the motor and propeller are turned to change its course. Acoustic energy is reflected downwardly by the wing, which further serves as a propeller guard by deflecting vegetation and submerged objects away from the propeller [10], and as a shield for sonar transducers which may be employed in conjunction with the motor [9] to locate fish or gauge water depth.

DETAILED DESCRIPTION OF THE INVENTION

Figure 1:
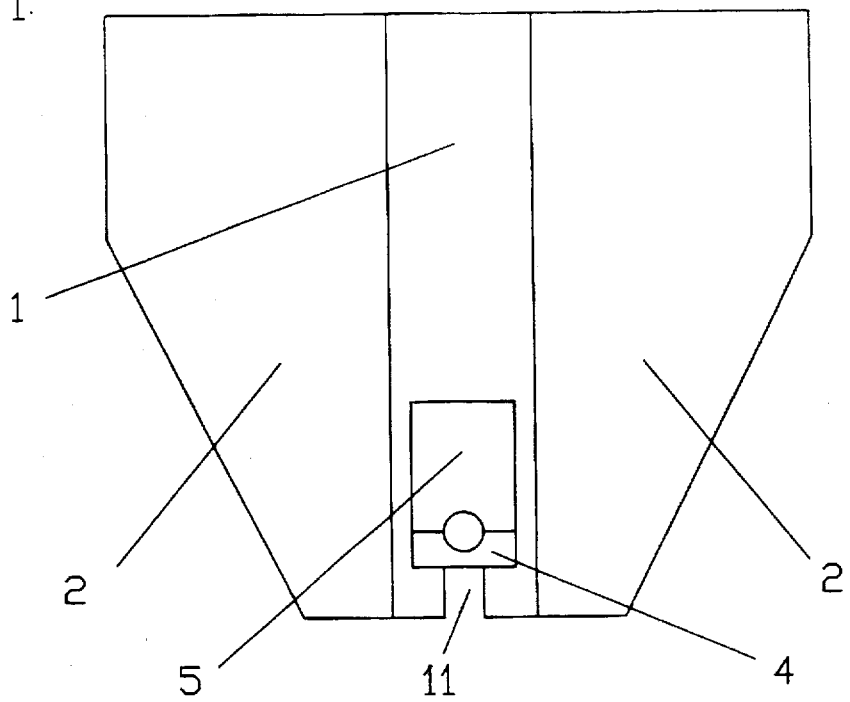
FIG. 1 is a top view of the hydrofoil and means for attaching it to a marine propulsion device.
Figure 2:
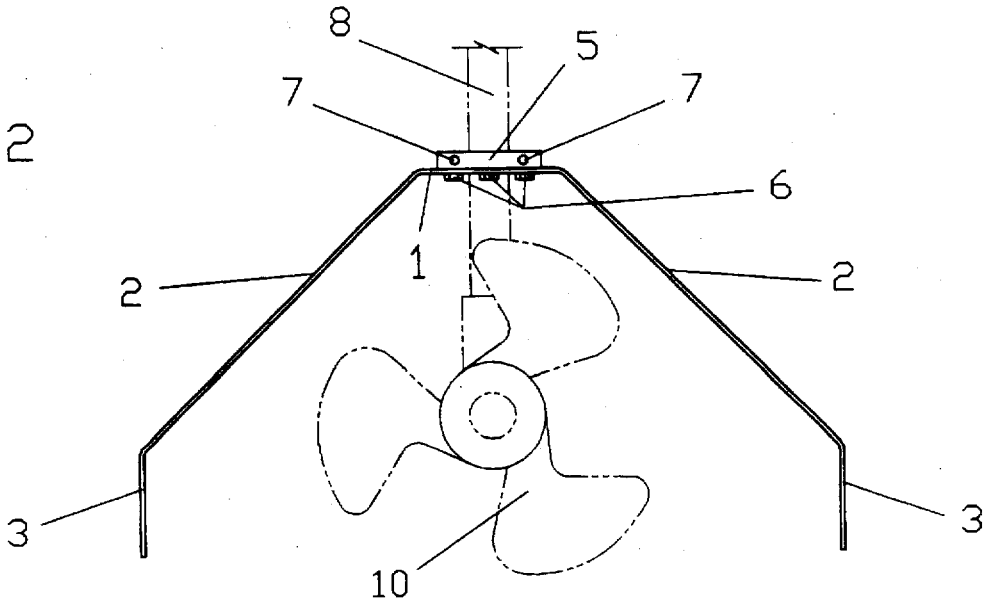
FIG. 2 is a rear elevation view of the hydrofoil and means for affixing it to a typical electric trolling motor, shown in broken lines.
Figure 3:
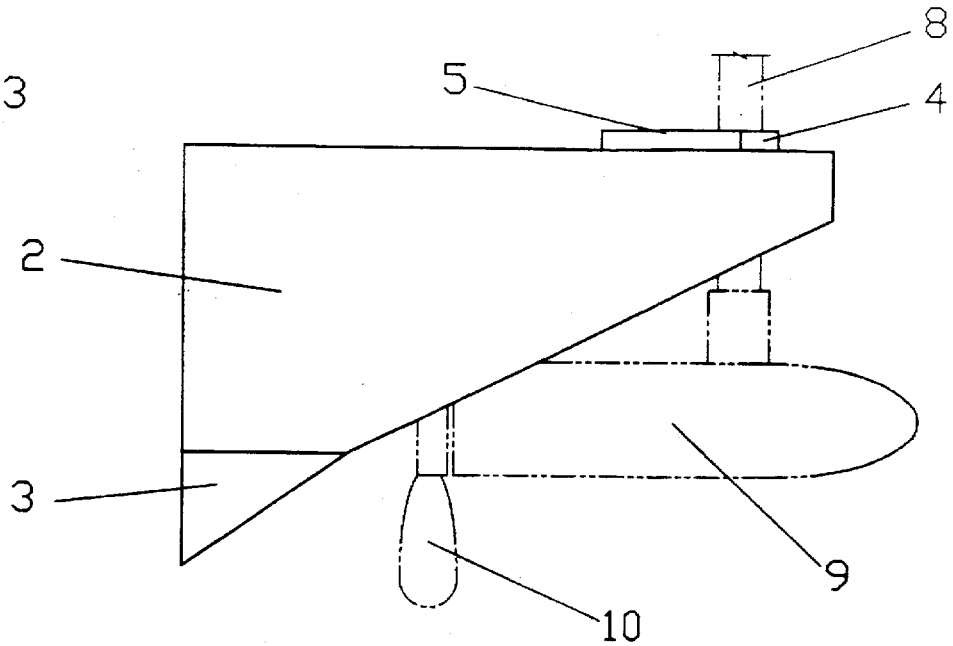
FIG. 3 is a side elevation view of the hydrofoil affixed to a typical electric trolling motor, shown in broken lines.
Figure 4:
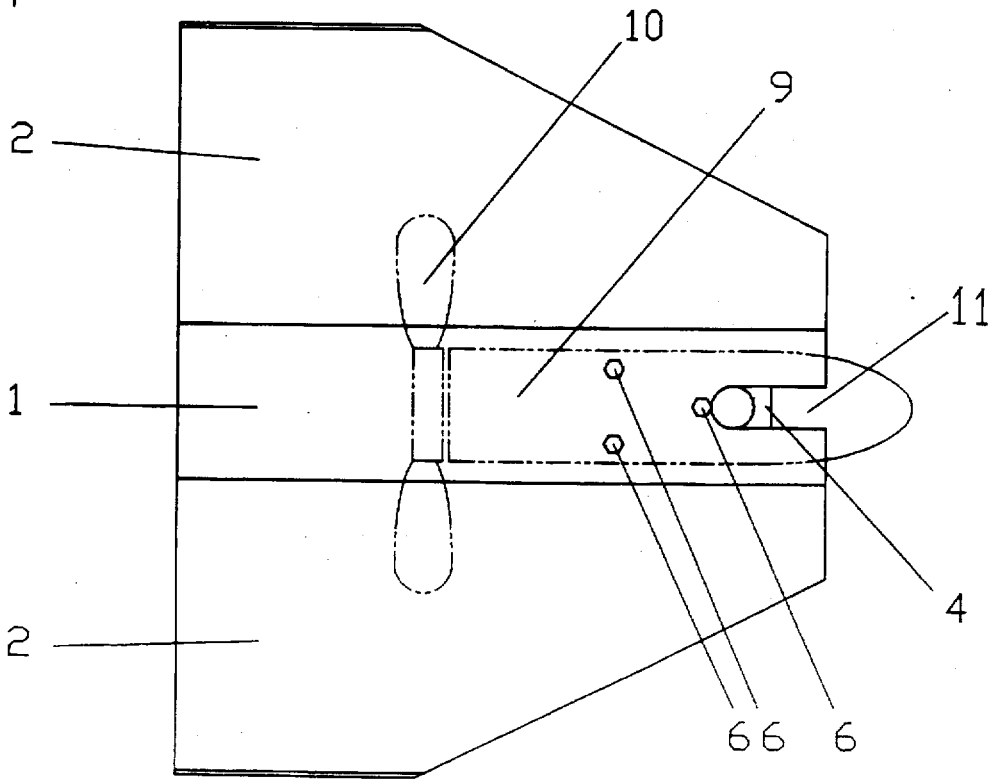
FIG. 4 is a bottom view of the hydrofoil and means for affixing it to a typical electric trolling motor, shown in broken lines.
Figure 5:
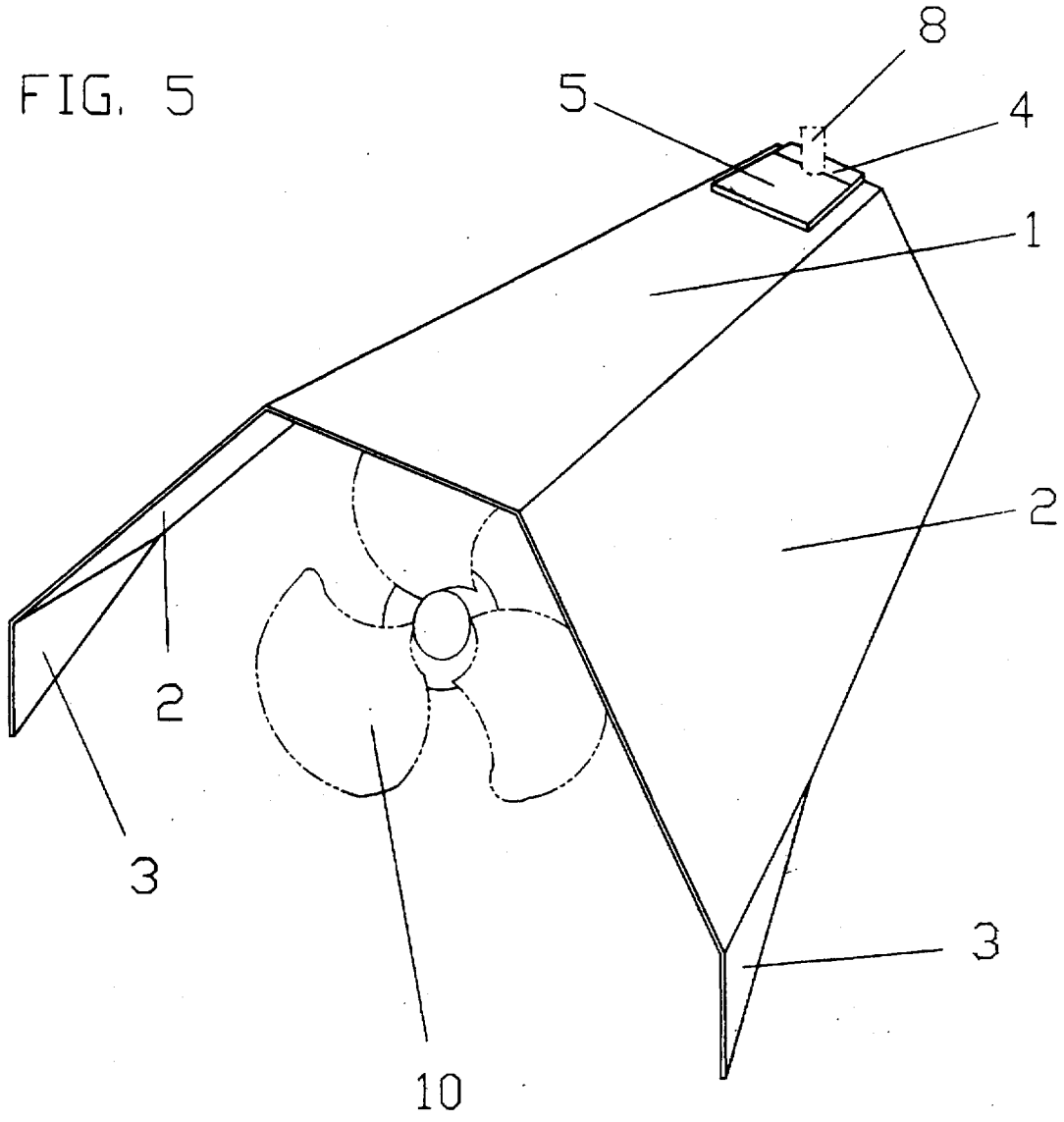
FIG. 5 is a perspective rear view of the hydrofoil and means for affixing it to a typical trolling motor, shown in broken lines.

In one embodiment of this invention, the hydrofoil is formed from a rigid isosceles triangular sheet of approximately 0.125 inch-thick aluminum plate, with the apex of the triangle removed along a line parallel to its base. At the front end of the center surface [1] where the apex has been removed, a notch [11] is created which is wide enough to receive a trolling motor shaft [8], typically ranging from 0.875 to 1.25 inches in diameter. The side surfaces [2] are formed from the isosceles triangular sheet by conventional techniques known to those skilled in the metal-forming arts, by bending the sheet downwardly at substantially a 45 degree angle from the plane of the center surface [1], along two lines at equal distances from and parallel to the axis formed by the front and rear ends of the center surface [1]. The rudder surfaces [3] are formed by further bending the sheet away from the plane of the center surface [1] along two lines parallel to the first two bends at substantially a 45 degree angle from the planes of the side surfaces [2], so the rudder surfaces [3] are perpendicular to the center surface [1]. The side surfaces [2] are each preferably wider than the center surface [1], and the rudder surfaces [3] are each preferably narrower than the center surface [1], with respect to the base of the triangular sheet from which the wing is formed.

In the preferred embodiment of this invention, the hydrofoil is formed from a rigid isosceles triangular sheet of approximately 0.25 to 0.1875 inch-thick translucent thermoplastic material such as Lexan (brand of polycarbonate), so that the propeller [10], motor [9] and any submerged entanglements or obstructions can be seen through the hydrofoil by occupants of the marine vessel. The apex of the triangle is removed and a notch [11] created as in the previously described embodiment. The center [1], side [2] and rudder [3] surfaces of the triangular sheet are also shaped similarly to the metallic embodiment by conventional thermal methods known to those skilled in the art of thermoplastic fabrication.

The hydrofoil is adjustably and fixedly attached to the shaft [8] so that it remains a fixed distance above the top of the propeller [10], preferably two to three inches, and so that it does not rotate about the shaft [8], thereby keeping the axis of the front and rear ends of the center surface [1] aligned with the motive direction of the vortex created by the propeller [10].

The center surface [1] of the hydrofoil is fixedly attached to the aft attachment means [5], a block of metal having a semicircular indentation appropriately sized to receive the shaft [8], by a plurality (two or more) vertical fasteners [6] such as hex-head screws, which are preferably driven from the underside of the hydrofoil through it, then securely into but not completely through the aft attachment means [5]. The shaft [8] is positioned as desired within the notch [11] of the hydrofoil in contact with the semicircular indentation of the aft attachment means [5], then the fore attachment means [4] is secured to the aft attachment means [5] using horizontal fasteners [7] such as bolts, which pass through both fore [4] and aft [5] attachment means to hold them firmly together and thereby firmly attach the hydrofoil to the shaft [8].

I claim:

1. A hydrofoil accessory for a marine propulsion device which has propeller means, comprising:

a wing having a rigid center surface, two rigid side surfaces opposite each other and extending downwardly from the center surface, and two rigid rudder surfaces opposite each other and extending downwardly from the side surfaces;

the center surface having a front end and a rear end, the center surface being substantially parallel to the surface of the water when the wing is in use;

the side surfaces being substantially mirror-images of each other, disposed on either side of and continuously connected to the center surface, each side surface extending downwardly from the surface of the water when the wing is in use;

the rudder surfaces being substantially mirror-images of each other, disposed on either side of and continuously connected to the side surfaces, each rudder surface being substantially perpendicular to the surface of the water when the wing is in use; and means for adjustably attaching the front end of the center surface of the wing to the marine propulsion device, with the front end of the center surface disposed above and forward of the propeller means, and with the side and rudder surfaces extending aft of the propeller means and downwardly from the surface of the water, whereby the hydrodynamic effect of the wing is to redirect and concentrate the kinetic energy of the vortex as it flows under the wing and to reflect acoustic energy downwardly, and whereby the rudder surfaces aid in steering and maneuvering the vessel.

2. A hydrofoil accessory as in claim 1, wherein the side surfaces are planar and extend downwardly at approximately a 45 degree angle from the planar center surface, and wherein the rudder surfaces further extend downwardly from the side surfaces at approximately a 45 degree angle and are substantially perpendicular to the center surface.

3. A hydrofoil accessory as in claim 2 wherein the surfaces are constructed from a rigid translucent thermoplastic material.

4. A process for contouring a conical hydrodynamic vortex created by a propelling means of a marine propulsion device, comprising the steps of:

constructing a hydrofoil as in claim 1 having a surface which is approximately congruent with the conical hydrodynamic vortex created by the propelling means of the marine propulsion device; and adjustably and fixedly disposing the hydrofoil on the marine propulsion device so that it surrounds and is in hydrodynamic contact with the portion of the vortex closest to the surface of the water to redirect and concentrate the kinetic energy of the vortex, and so that acoustic energy from the marine propulsion device is directed downwardly from the surface of the water.

5. A process for contouring a conical hydrodynamic vortex created by a propelling means of a marine propulsion device, comprising the steps of:

constructing a hydrofoil of claim 2 having a surface which is approximately congruent with the conical hydrodynamic vortex created by the propelling means of the marine propulsion device; and adjustably and fixedly disposing the hydrofoil on the marine propulsion device so that it surrounds and is in hydrodynamic contact with the portion of the vortex closest to the surface of the water to redirect and concentrate the kinetic energy of the vortex, and so that acoustic energy from the marine propulsion device is directed downwardly from the surface of the water.

* * * * *